US009141032B1

(12) United States Patent
Murata et al.

(10) Patent No.: US 9,141,032 B1
(45) Date of Patent: Sep. 22, 2015

(54) DEVELOPING DEVICE AND IMAGE FORMING APPARATUS

(71) Applicant: FUJI XEROX CO., LTD., Minato-ku, Tokyo (JP)

(72) Inventors: Shigemi Murata, Kanagawa (JP); Shigeru Inaba, Kanagawa (JP); Shinji Okuyama, Kanagawa (JP); Norihiro Tamazawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/585,494

(22) Filed: Dec. 30, 2014

(30) Foreign Application Priority Data

Mar. 20, 2014 (JP) ..... 2014-058908

(51) Int. Cl.
*G03G 15/08* (2006.01)

(52) U.S. Cl.
CPC ..... *G03G 15/0889* (2013.01); *G03G 15/0822* (2013.01)

(58) Field of Classification Search
CPC ..... G03G 15/0889; G03G 15/0822
USPC ..... 399/254, 256
See application file for complete search history.

(56) References Cited

U.S. PATENT DOCUMENTS 8,676,094 B2 * 3/2014 Nakajima et al. ..... 399/254
2011/0229208 A1 * 9/2011 Watanabe ..... 399/254

FOREIGN PATENT DOCUMENTS

JP 2-208675 A 8/1990

* cited by examiner

*Primary Examiner* — Hoang Ngo
(74) *Attorney, Agent, or Firm* — Sughrue Mion, PLLC

(57) ABSTRACT

A developing device includes: a first transport member that transports developer in a developer container; a second transport member that transports the developer in a direction opposite to a direction of transport by the first transport member; an inflow portion provided at a downstream end in the direction of transport by the second transport member and on an outer side with respect to an end of a developer carrying body, the inflow portion allowing the developer to flow from a second housing into a first housing; a high-speed transport portion provided in a range corresponding to the inflow portion and that transports the developer at a higher speed; and a regulating member provided at a position corresponding to a downstream end of the high-speed transport portion in the direction of transport by the first transport member and that regulates a height of a mound of developer in the first housing.

5 Claims, 7 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2014-058908 filed Mar. 20, 2014.

BACKGROUND

Technical Field

The present invention relates to a developing device and an image forming apparatus.

SUMMARY

According to an aspect of the invention, there is provided a developing device including a developer container that contains developer; a developer carrying body provided in the developer container and configured to rotate while carrying the developer, the developer carrying body facing an image carrying body on which a latent image is to be formed; a first transport member including a rotating shaft and a transport blade supported by the rotating shaft, the first transport member being configured to transport the developer in the developer container while stirring the developer; a second transport member including a rotating shaft and a transport blade supported by the rotating shaft, the second transport member being provided parallel to the first transport member in a horizontal direction and being configured to transport the developer while stirring the developer, the second transport member transporting the developer in a second direction opposite to a first direction in which the first transport member transports the developer; a partition member provided between the first transport member and the second transport member and separating a space in the developer container into a first housing in which the first transport member is provided and a second housing in which the second transport member is provided; an inflow portion provided in the developer container at a downstream end in the second direction and on an outer side with respect to an end of the developer carrying body, the inflow portion allowing the developer to flow from the second housing into the first housing; a high-speed transport portion provided in a range corresponding to the inflow portion and extending in the first direction, the high-speed transport portion being configured to transport the developer at a higher speed than a speed at which the developer in a range corresponding to the developer carrying body is transported; and a regulating member provided at a position corresponding to a downstream end of the high-speed transport portion in the first direction, the regulating member being configured to regulate a height of a mound of developer in the first housing.

BRIEF DESCRIPTION OF THE DRAWINGS

Exemplary embodiments of the present invention will be described in detail based on the following figures, wherein.

DETAILED DESCRIPTION

Figure 1:
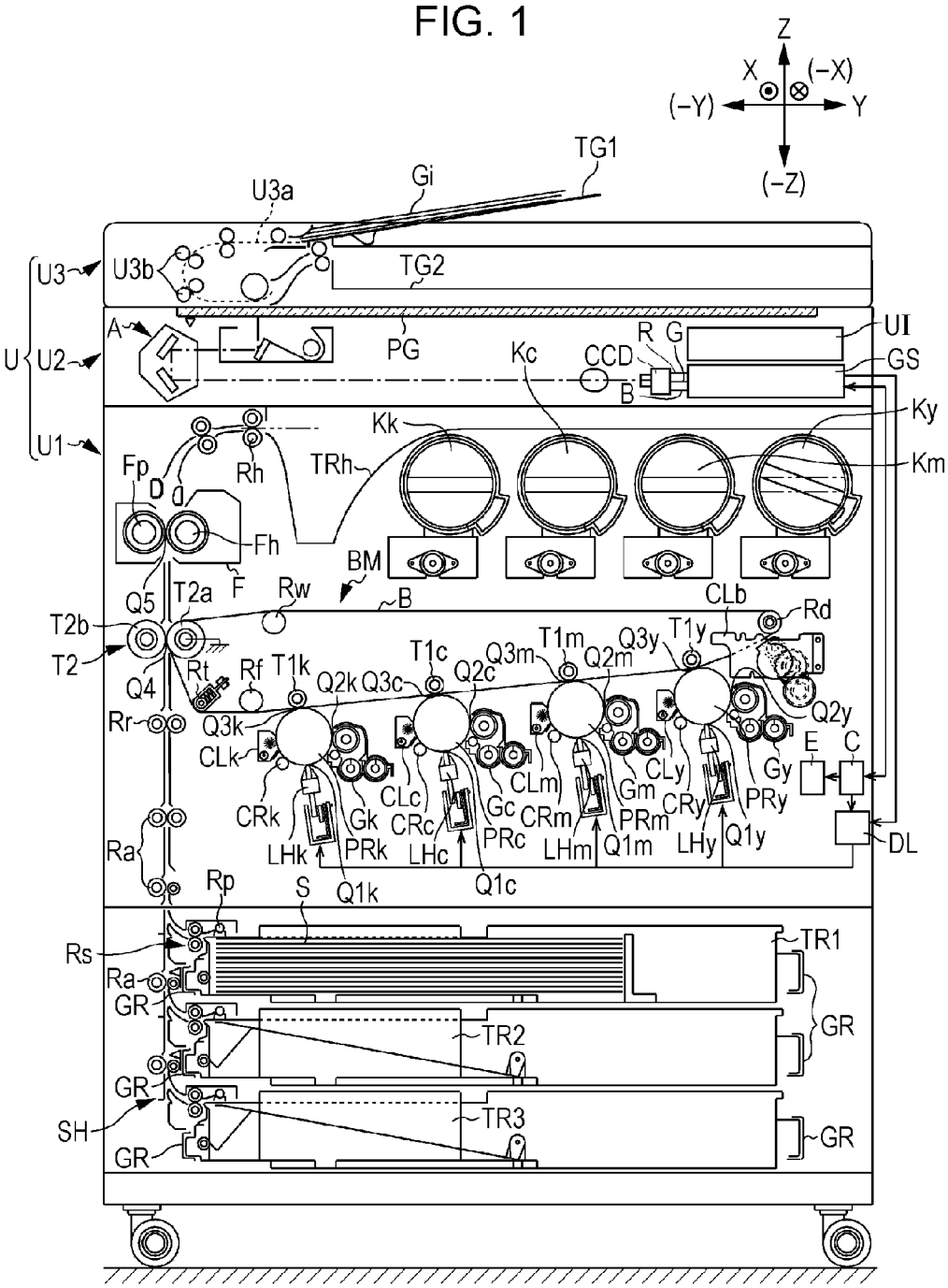
FIG. 1 illustrates an image forming apparatus according to a first exemplary embodiment.

Exemplary embodiments of the present invention will now be described with reference to the accompanying drawings. The present invention is not limited to the following exemplary embodiments.

For easy understanding of the following description, directions in the drawings are defined as follows: The X-axis direction corresponds to the anteroposterior direction, the Y-axis direction corresponds to the horizontal direction, and the Z-axis direction corresponds to the vertical direction. Furthermore, the sides indicated by arrows X, −X, Y, −Y, Z, and −Z in the drawings correspond to the front, rear, right, left, upper and lower sides, respectively.

In each of the drawings, a circle with a dot in its center represents an arrow heading toward the front side from the back side of the page, and a circle with a cross in its center represents an arrow heading toward the back side from the front side of the page.

In the following description given with reference to the drawings, for easy understanding, elements that are irrelevant to the exemplary embodiments are not illustrated.

First Exemplary Embodiment

FIG. 1 illustrates an image forming apparatus according to a first exemplary embodiment.

Figure 2:
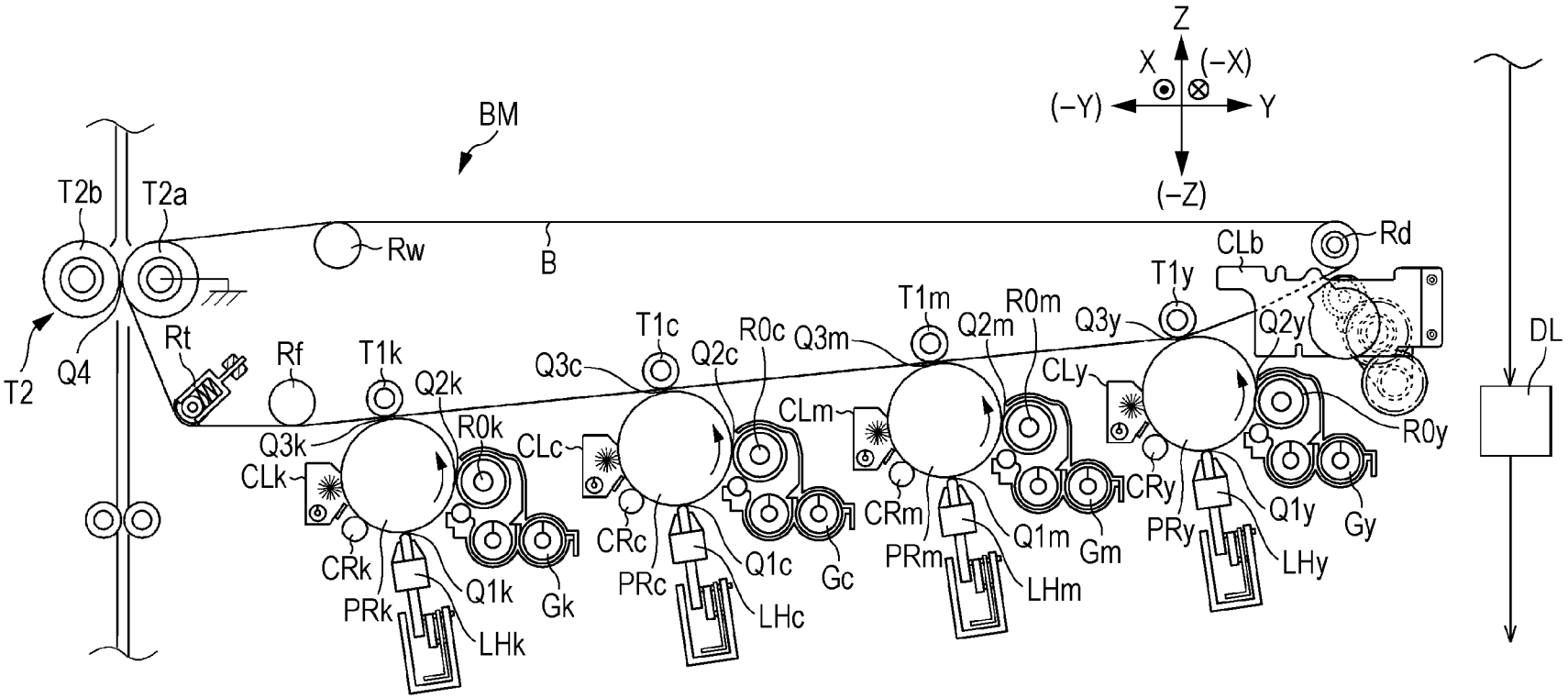
FIG. 2 illustrates relevant parts of the image forming apparatus according to the first exemplary embodiment.

FIG. 2 illustrates relevant parts of the image forming apparatus according to the first exemplary embodiment.

Referring to FIG. 1, a copier U as an exemplary image forming apparatus according to the first exemplary embodiment of the present invention includes a printer unit U1 as an exemplary recording unit and as an exemplary image recording device. A scanner unit U2 as an exemplary reading unit and as an exemplary image reading device is supported at the top of the printer unit U1. An automatic feeder U3 as an exemplary document transporting device is supported at the top of the scanner unit U2. A user interface UI as an exemplary input unit is provided in the scanner unit U2 according to the first exemplary embodiment. An operator operates the copier U by inputting information on the user interface UI.

A document tray TG1 as an exemplary medium holder is provided at the top of the automatic feeder U3. The document tray TG1 holds a stack of plural pages of a document Gi to be copied. A document ejection tray TG2 as an exemplary document ejecting portion is provided below the document tray TG1. Pairs of document transport rollers U3*b* are provided between the document tray TG1 and the document ejection tray TG2 and along a document transport path U3*a*.

A transparent platen glass PG as an exemplary document table is provided on the upper surface of the scanner unit U2.

The scanner unit U2 according to the first exemplary embodiment includes a reading optical system A provided below the platen glass PG. The reading optical system A according to the first exemplary embodiment is supported in such a manner as to be movable in the horizontal direction along the lower surface of the platen glass PG. The reading optical system A is normally stationary at the initial position as illustrated in FIG. 1.

An imaging charge-coupled device (CCD) as an exemplary imaging member is provided on the right side of the reading optical system A. The imaging CCD is electrically connected to an image processing unit GS.

The image processing unit GS is electrically connected to a writing circuit DL included in the printer unit U1. The writing circuit DL is electrically connected to light-emitting-diode (LED) heads LHy, LHm, LHc, and LHk as exemplary latent image forming devices.

Photoconductor drums PRy, PRm, PRc, and PRk as exemplary image carrying bodies are provided above the respective LED heads LHy, LHm, LHc, and LHk.

Charging rollers CRy, CRm, CRc, and CRk as exemplary chargers are provided in such a manner as to face the respective photoconductor drums PRy, PRm, PRc, and PRk. A power circuit E applies a charging voltage to the charging rollers CRy, CRm, CRc, and CRk. The power circuit E is controlled by a controller C as an exemplary control unit. The controller C controls various elements by transmitting and receiving signals to and from the image processing unit GS, the writing circuit DL, and other associated elements.

The LED heads LHy, LHm, LHc, and LHk emit writing light to the surfaces of the respective photoconductor drums PRy, PRm, PRc, and PRk in respective writing areas Q1*y*, Q1*m*, Q1*c*, and Q1*k* defined on the downstream side with respect to the respective charging rollers CRy, CRm, CRc, and CRk in the direction of rotation of the photoconductor drums PRy, PRm, PRc, and PRk.

Developing devices Gy, Gm, Gc, and Gk are provided in such a manner as to face the surfaces of the respective photoconductor drums PRy, PRm, PRc, and PRk in respective development areas Q2*y*, Q2*m*, Q2*c*, and Q2*k* defined on the downstream side with respect to the respective writing areas Q1*y*, Q1*m*, Q1*c*, and Q1*k* in the direction of rotation of the photoconductor drums PRy, PRm, PRc, and PRk.

First transfer areas Q3*y*, Q3*m*, Q3*c*, and Q3*k* are defined on the downstream side with respect to the respective development areas Q2*y*, Q2*m*, Q2*c*, and Q2*k* in the direction of rotation of the photoconductor drums PRy, PRm, PRc, and PRk. The first transfer areas Q3*y*, Q3*m*, Q3*c*, and Q3*k* are in contact with an intermediate transfer belt B as an exemplary intermediate transfer body. In the first transfer areas Q3*y*, Q3*m*, Q3*c*, and Q3*k*, first transfer rollers T1*y*, T1*m*, T1*c*, and T1*k* as exemplary first transfer devices are provided across the intermediate transfer belt B from the respective photoconductor drums PRy, PRm, PRc, and PRk.

Drum cleaners CLy, CLm, CLc, and CLk as exemplary image-carrying-body-cleaning devices are provided on the downstream side with respect to the respective first transfer areas Q3*y*, Q3*m*, Q3*c*, and Q3*k* in the direction of rotation of the photoconductor drums PRy, PRm, PRc, and PRk.

A belt module BM as an exemplary intermediate transfer device is provided above the photoconductor drums PRy, PRm, PRc, and PRk. The belt module BM includes the intermediate transfer belt B. The intermediate transfer belt B is rotatably supported by a driving roller Rd as an exemplary driving member, a tension roller Rt as an exemplary tension member, a walking roller Rw as an exemplary meandering correcting member, an idler roller Rf as an exemplary idler member, a backup roller T2*a* as an exemplary counter member provided in a second transfer area Q4, and the first transfer rollers T1*y*, T1*m*, T1*c*, and T1*k*.

A second transfer roller T2*b* as an exemplary second transfer member is provided across the intermediate transfer belt B from the backup roller T2*a*. The backup roller T2*a* and the second transfer roller T2*b* constitute a second transfer device T2. The second transfer area Q4 is defined between the second transfer roller T2*b* and the intermediate transfer belt B.

The first transfer rollers T1*y*, T1*m*, T1*c*, and T1*k*, the intermediate transfer belt B, the second transfer device T2, and other associated elements constitute a transfer device T1+T2+B according to the first exemplary embodiment that transfers images formed on the photoconductor drums PRy, PRm, PRc, and PRk to a medium.

A belt cleaner CLb as an exemplary intermediate-transfer-body-cleaning device is provided on the downstream side with respect to the second transfer area Q4 in the direction of rotation of the intermediate transfer belt B.

Cartridges Ky, Km, Kc, and Kk as exemplary developer containers are provided above the belt module BM. The cartridges Ky, Km, Kc, and Kk contain respective developers to be supplied to the respective developing devices Gy, Gm, Gc, and Gk. The cartridges Ky, Km, Kc, and Kk and the developing devices Gy, Gm, Gc, and Gk are connected to each other with developer supplying devices (not illustrated), respectively.

Paper trays TR1 to TR3 as exemplary medium holders are provided at the bottom of the printer unit U1. The paper trays TR1 to TR3 are supported by guide rails GR as exemplary guide members in such a manner as to be removable in the anteroposterior direction. The paper trays TR1 to TR3 each hold sheets S as exemplary media.

A pickup roller Rp as an exemplary medium pickup member is provided at the upper left of each of the paper trays TR1 to TR3. A pair of separating rollers Rs as exemplary separating members are provided on the left side of the pickup roller Rp.

A medium transport path SH extending upward is provided on the left side of the paper trays TR1 to TR3. The medium transport path SH is provided with plural pairs of transport rollers Ra as exemplary medium transporting members. The medium transport path SH is also provided with a pair of registration rollers Rr as exemplary feeding members in a downstream portion of the medium transport path SH and on the upstream side with respect to the second transfer area Q4 in a direction of sheet transport.

A fixing device F is provided above the second transfer area Q4. The fixing device F includes a heat roller Fh as an exemplary heating member, and a pressure roller Fp as an exemplary pressing member. The area where the heat roller Fh and the pressure roller Fp are in contact with each other corresponds to a fixing area Q5.

A pair of output rollers Rh as exemplary medium transporting members are provided obliquely above the fixing device F. An output tray TRh as an exemplary medium output portion is provided on the right side of the pair of output rollers Rh.

Image Forming Operation

The plural pages of the document Gi held on the document tray TG1 are sequentially transported through a document reading position defined on the platen glass PG and are sequentially output onto the document ejection tray TG2.

If copying is to be performed by automatically transporting the pages of the document Gi with the automatic feeder U3, the reading optical system A performs exposure, while being stationary at the initial position, on each of the pages of the document Gi that sequentially pass through the reading position on the platen glass PG.

If the operator is to perform copying by manually placing each of the pages of the document Gi on the platen glass PG, the page of the document Gi on the platen glass PG is scanningly exposed to light emitted from the reading optical system A moving in the horizontal direction.

The light reflected by the page of the document Gi travels through the reading optical system A and is collected on the imaging CCD. The imaging CCD converts the light reflected by the page of the document Gi and collected on an imaging plane of the CCD into electrical signals for red (R), green (G), and blue (B).

The image processing unit GS converts the electrical signals for R, G, and B inputted thereto from the imaging CCD into pieces of image information on black (K), yellow (Y), magenta (M), and cyan (C) and temporarily stores the pieces of image information. The image processing unit GS outputs the temporarily stored pieces of image information, as pieces of image information for latent image formation, to the writing circuit DL at predetermined timings.

In a case where the document image is monochrome, only the piece of image information on black (K) is inputted to the writing circuit DL.

The writing circuit DL includes driving circuits (not illustrated) provided for the respective colors of Y, M, C, and K and outputs signals corresponding to the respective pieces of image information that have been inputted thereto to the respective LED heads LHy, LHm, LHc, and LHk, which are provided for the respective colors, at respective predetermined timings.

The surfaces of the photoconductor drums PRy, PRm, PRc, and PRk are charged by the respective charging rollers CRy, CRm, CRc, and CRk. The LED heads LHy, LHm, LHc, and LHk form electrostatic latent images on the surfaces of the photoconductor drums PRy, PRm, PRc, and PRk in the writing areas Q1*y*, Q1*m*, Q1*c*, and Q1*k*, respectively. The developing devices Gy, Gm, Gc, and Gk develop the electrostatic latent images on the surfaces of the photoconductor drums PRy, PRm, PRc, and PRk into toner images as exemplary visual images in the development areas Q2*y*, Q2*m*, Q2*c*, and Q2*k*, respectively. As the developing devices Gy, Gm, Gc, and Gk consume the respective developers, fresh developers are supplied to the developing devices Gy, Gm, Gc, and Gk from the cartridges Ky, Km, Kc, and Kk, respectively, in accordance with the amount of developer consumption.

The toner images on the surfaces of the photoconductor drums PRy, PRm, PRc, and PRk are transported to the respective first transfer areas Q3*y*, Q3*m*, Q3*c*, and Q3*k*. A first transfer voltage of a polarity opposite to the polarity of the charges given to the toner images is applied to the first transfer rollers T1*y*, T1*m*, T1*c*, and T1*k* at predetermined timings by the power circuit E. Hence, in the first transfer areas Q3*y*, Q3*m*, Q3*c*, and Q3*k*, the toner images on the photoconductor drums PRy, PRm, PRc, and PRk are sequentially transferred to the intermediate transfer belt B with the first transfer voltage in such a manner as to be superposed one on top of another. In a case where a monochrome image in black (K) is to be formed, only the toner image in black (K) is transferred from the photoconductor drum PRk for black (K) to the intermediate transfer belt B.

The toner images on the photoconductor drums PRy, PRm, PRc, and PRk are thus first-transferred to the intermediate transfer belt B as an exemplary intermediate transfer body by the first transfer rollers T1*y*, T1*m*, T1*c*, and T1*k*. Substances remaining and adhering to the surfaces of the photoconductor drums PRy, PRm, PRc, and PRk that have been through the first transfer are removed by the drum cleaners CLy, CLm, CLc, and CLk. The surfaces of the photoconductor drums PRy, PRm, PRc, and PRk that have been cleaned are charged again by the charging rollers CRy, CRm, CRc, and CRk.

One of the sheets S in the paper trays TR1 to TR3 is picked up by a corresponding one of the pickup rollers Rp at a preset feed timing. If plural sheets S are picked up at a time by the pickup roller Rp, one of the plural sheets S is separated from the others by the pair of separating rollers Rs. The sheet S that has passed through the pair of separating rollers Rs is transported to the pair of registration rollers Rr by the plural pairs of transport rollers Ra.

The pair of registration rollers Rr feed the sheet S in synchronization with the movement of the superposition of the toner images on the intermediate transfer belt B to the second transfer area Q4.

When the sheet S fed by the pair of registration rollers Rr passes through the second transfer area Q4, the superposition of the toner images on the intermediate transfer belt B is transferred to the sheet S with a second transfer voltage applied to the second transfer roller T2*b*.

Residual toners on the surface of the intermediate transfer belt B that has passed through the second transfer area Q4 are removed by the belt cleaner CLb.

The superposition of the toner images on the sheet S that has passed through the second transfer area Q4 is subject to heat and pressure in the fixing device F when passing through the fixing area Q5, thereby being fixed.

The sheet S having the fixed toner images is ejected to the output tray TRh by the pair of output rollers Rh.

Configuration of Developing Device

Figure 3:
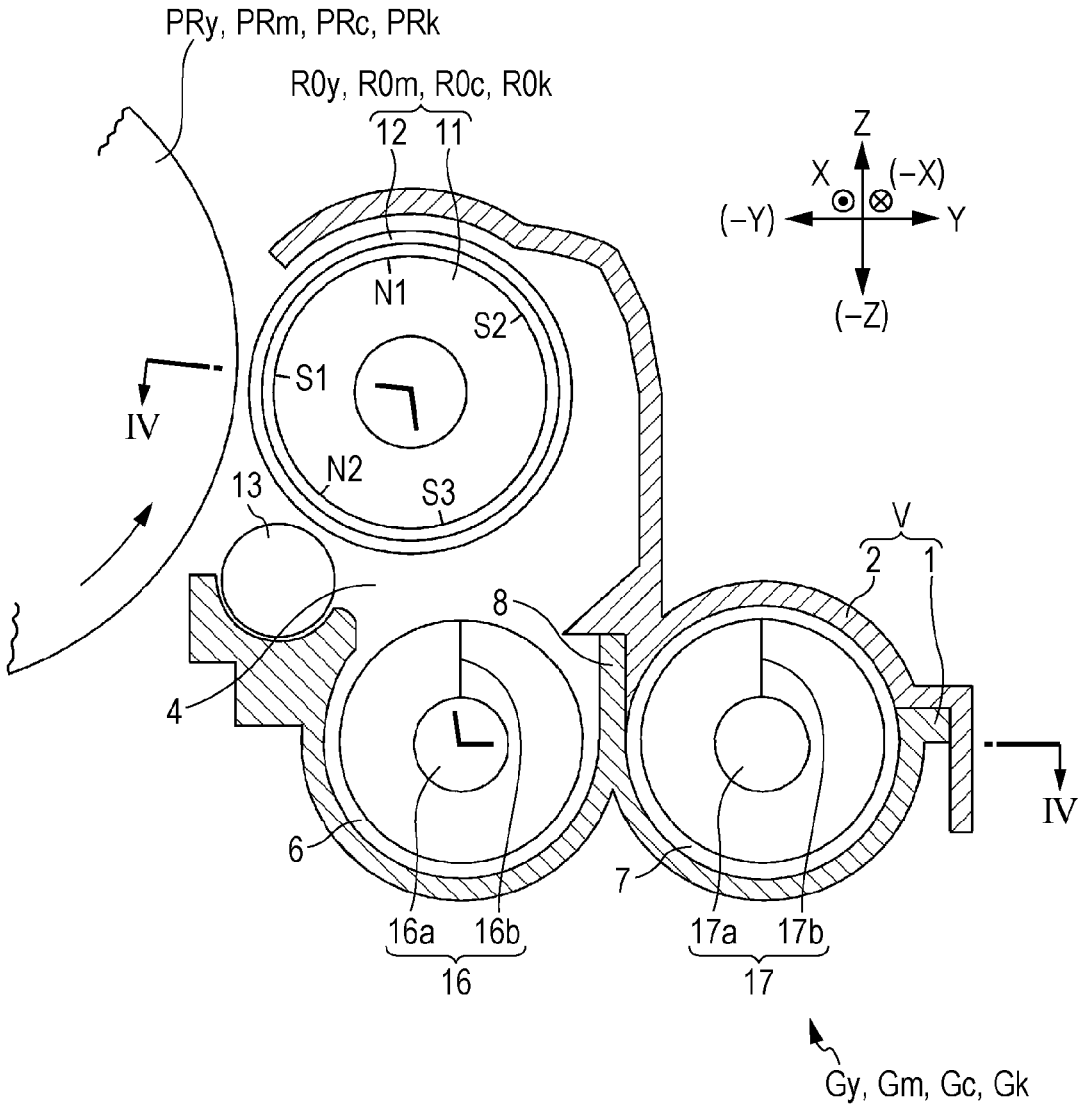
FIG. 3 illustrates a developing device according to the first exemplary embodiment.

FIG. 3 illustrates one of the developing devices Gy, Gm, Gc, and Gk according to the first exemplary embodiment.

Figure 4:
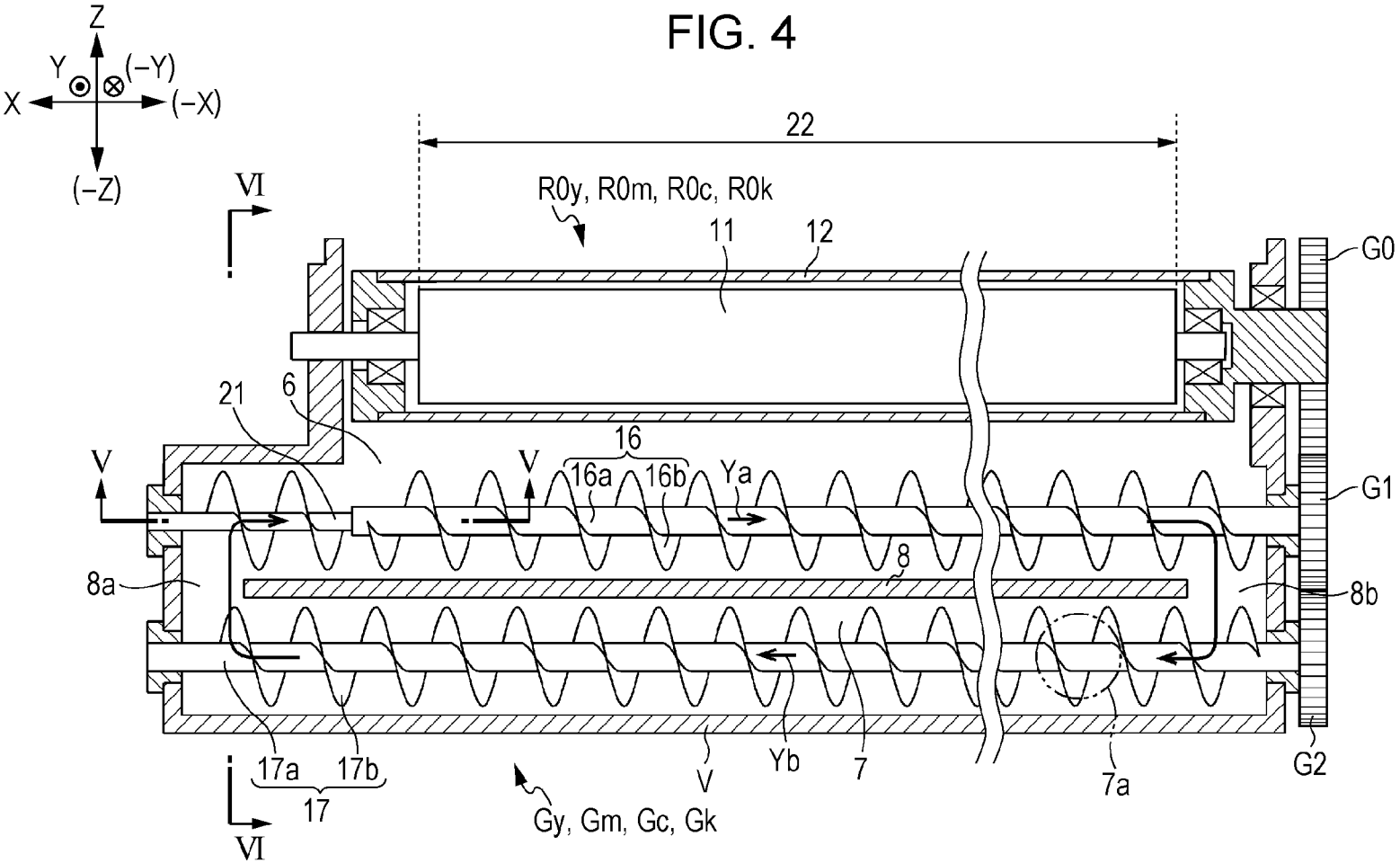
FIG. 4 is a sectional view taken along line IV-IV illustrated in FIG. 3.

FIG. 4 is a sectional view taken along line IV-IV illustrated in FIG. 3.

The developing devices Gy, Gm, Gc, and Gk according to the first exemplary embodiment of the present invention will now be described. The developing devices Gy, Gm, Gc, and Gk for the respective colors have the same configuration. Therefore, only the developing device Gy for the Y color will be described in detail, and detailed description of the developing devices Gm, Gc, and Gk for the other colors is omitted.

Referring to FIGS. 3 and 4, the developing device Gy provided in such a manner as to face the photoconductor drum PRy includes a developer container V that stores a two-component developer containing toner and a carrier. Referring to FIG. 3, the developer container V includes a container body 1 provided on the lower side thereof, and a container covering 2 as an exemplary lid member provided on the upper side thereof and supported by the container body 1. The container covering 2 covers the upper side of the container body 1.

Referring to FIGS. 3 and 4, the container body 1 includes a developing roller chamber 4 as an exemplary developer-carrying-body housing provided in an upper left portion thereof, and a supply chamber 6 as an exemplary first housing provided below the developing roller chamber 4. The supply chamber 6 is connected to the developing roller chamber 4. A stirring chamber 7 as an exemplary second housing is provided on the right side of the supply chamber 6.

The supply chamber 6 and the stirring chamber 7 are separated from each other by a partition wall 8 as an exemplary partition member. Referring to FIG. 4, a first inflow portion 8*a* as an exemplary first connecting portion is provided on the front side of the partition wall 8. The first inflow portion 8*a* connects the supply chamber 6 and the stirring chamber 7 to each other. In the first exemplary embodiment, the first inflow portion 8*a* is provided on the front side with respect to the front end of the developing roller chamber 4. Furthermore, a second inflow portion 8*b* as an exemplary second connecting portion is provided on the rear side of the partition wall 8. The second inflow portion 8*b* connects the supply chamber 6 and the stirring chamber 7 to each other.

The developing roller chamber 4 houses a developing roller R0*y* as an exemplary developer carrying body. An upper left portion of the outer surface of the developing roller R0*y* faces the photoconductor drum PRy. The developing roller R0*y* includes a magnetic roller 11 as an exemplary magnetic member. Referring to FIG. 4, the magnetic roller 11 is nonrotatably supported by the developer container V. Referring to FIGS. 3 and 4, the magnetic roller 11 is provided therearound with a developing sleeve 12 as an exemplary rotating body. The developing sleeve 12 is rotatably supported by the developer container V. The rear end of the developing sleeve 12 is supported by a gear G0 as an exemplary driving-force-transmitting member. The gear G0 is configured to receive a driving force transmitted from a motor (not illustrated) as an exemplary driving source. In the developing device Gy according to the first exemplary embodiment, when the driving force is transmitted from the motor, the developing sleeve 12 rotates in a direction in which the surface of the photoconductor drum PRy moves in the development area Q2*y*.

A trimmer 13 as an exemplary layer-thickness-regulating member is provided in a lower portion of the developing roller chamber 4. The trimmer 13 according to the first exemplary embodiment has a round columnar shape extending in the anteroposterior direction. The trimmer 13 is nonrotatably supported at a preset distance from the developing sleeve 12.

The magnetic roller 11 has a development magnetic pole S1, a trimming magnetic pole N2, a transport magnetic pole N1, a pickoff magnetic pole S2, and a pickup magnetic pole S3. The development magnetic pole S1 faces the development area Q2*y*. The trimming magnetic pole N2 is an exemplary magnetic pole for layer-thickness regulation and faces the trimmer 13. The trimming magnetic pole N2 has the opposite polarity to the development magnetic pole S1. The transport magnetic pole N1 is provided on the downstream side with respect to the development magnetic pole S1 in the direction of rotation of the developing sleeve 12. The transport magnetic pole N1 has the opposite polarity to the development magnetic pole S1. The pickoff magnetic pole S2 is an exemplary magnetic pole for developer release and is provided at a position on the downstream side with respect to the transport magnetic pole N1 in the direction of rotation of the developing sleeve 12. The pickoff magnetic pole S2 has the opposite polarity to the transport magnetic pole N1. The pickup magnetic pole S3 is an exemplary magnetic pole for developer attraction and is provided at a position on the downstream side with respect to the pickoff magnetic pole S2 and on the upstream side with respect to the trimming magnetic pole N2 in the direction of rotation of the developing sleeve 12. The pickup magnetic pole S3 has the same polarity as the pickoff magnetic pole S2 but the opposite polarity to the trimming magnetic pole N2.

Referring to FIGS. 3 and 4, a supply auger 16 as an exemplary first transport member is provided in the supply chamber 6. The supply auger 16 includes a rotating shaft 16*a* extending in the anteroposterior direction, and a helical or substantially helical transport blade 16*b* provided around the rotating shaft 16*a*. The rotating shaft 16*a* is provided with a gear G1 as an exemplary driving-force-transmitting member at the rear end thereof.

A stirring auger 17 as an exemplary second transport member is provided in the stirring chamber 7. As with the supply auger 16, the stirring auger 17 includes a rotating shaft 17*a* and a transport blade 17*b*, and is provided with a gear G2. The gears G0 to G2 are in mesh with one another.

Referring to FIG. 4, the stirring chamber 7 has a supply port 7*a* in a rear portion thereof. Developer is supplied from the cartridge Ky into the stirring chamber 7 through the supply port 7*a*.

Functions of Developing Device

In each of the developing devices Gy, Gm, Gc, and Gk configured as described above, when an image forming operation is started, the motor is activated to rotate the augers 16 and 17 and a corresponding one of the developing rollers R0*y*, R0*m*, R0*c*, and R0*k*. In the first exemplary embodiment, when the supply auger 16 is rotated, the supply auger 16 transports the developer in the supply chamber 6, while stirring the developer, from the first inflow portion 8*a* toward the second inflow portion 8*b* as illustrated by an arrow Ya. The developer thus transported to the second inflow portion 8*b* flows into the stirring chamber 7 through the second inflow portion 8*b*. When the stirring auger 17 is rotated, the stirring auger 17 transports the developer in the stirring chamber 7, while stirring the developer, from the second inflow portion 8*b* toward the first inflow portion 8*a* as illustrated by an arrow Yb. The developer thus transported to the first inflow portion 8*a* flows into the supply chamber 6 through the first inflow portion 8*a*. Thus, the supply chamber 6 and the stirring chamber 7 constitute a circulation chamber 6+7.

The developer in the supply chamber 6 is attracted to the developing sleeve 12 with the magnetic force exerted by the pickup magnetic pole S3. When the developer thus attracted to the developing sleeve 12 passes by the trimmer 13, only a portion of the developer that has passed through a preset gap between the trimmer 13 and the developing sleeve 12 is allowed to go past the trimmer 13. The developer thus gone past the trimmer 13 is used for the development of a corresponding one of the latent images on the photoconductor drums PRy, PRm, PRc, and PRk in a corresponding one of the development areas Q2*y*, Q2*m*, Q2*c*, and Q2*k*. Residual developer that has not been used for the development is transported while being attracted to the surface of the developing sleeve 12 with the magnetic fields produced between, for example, the development magnetic pole S1 and the transport magnetic pole N1 and between the transport magnetic pole N1 and the pickoff magnetic pole S2. In an area between the pickoff magnetic pole S2 and the pickup magnetic pole S3 that have the same polarity, the magnetic force that attracts the developer to the developing sleeve 12 is reduced. Hence, the developer attracted to the surface of the developing sleeve 12 in the area between the pickoff magnetic pole S2 and the pickup magnetic pole S3 comes off the developing sleeve 12 and returns to the circulation chamber 6+7.

Figure 5:
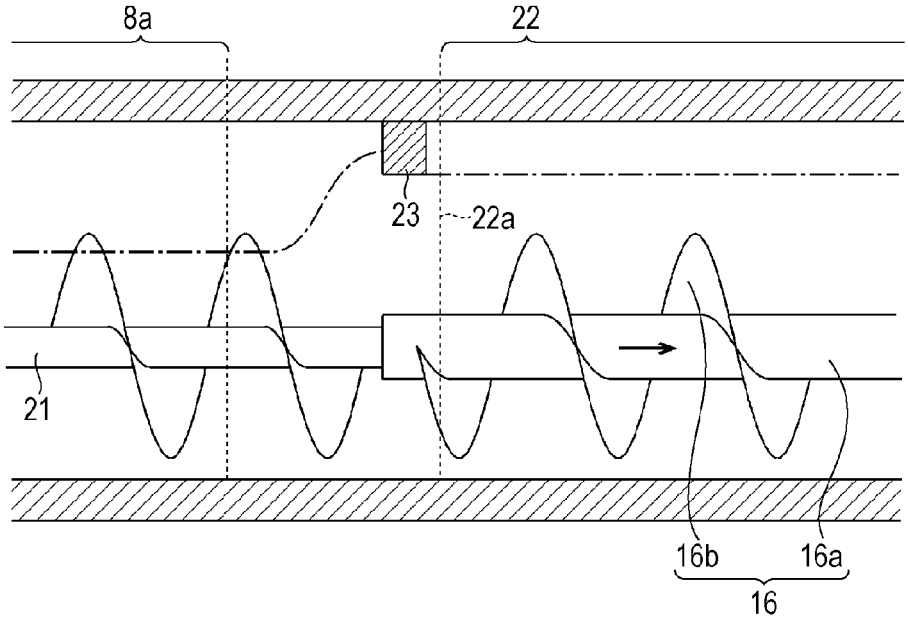
FIG. 5 is a sectional view taken along line V-V illustrated in FIG. 4.

FIG. 5 is a sectional view taken along line V-V illustrated in FIG. 4.

Referring to FIGS. 4 and 5, the rotating shaft 16*a* of the supply auger 16 according to the first exemplary embodiment includes a small-diameter portion 21 as an exemplary high-speed transport portion. The small-diameter portion 21 is provided at the upstream end of the rotating shaft 16*a* in the direction of developer transport. The small-diameter portion 21 extends over a range including the first inflow portion 8*a*, which is an exemplary inflow portion, up to a position on the downstream side with respect to the first inflow portion 8*a* and on the upstream side with respect to an upstream end 22*a* of a development range 22 in the direction of developer transport. The development range 22 is a range extending in the axial direction and in which development is performed by the developing roller R0*y*. The small-diameter portion 21 has a smaller diameter than the other portion of the rotating shaft 16*a* that extends over the development range 22. The outside diameter of the transport blade 16*b* is constant over the entirety of the supply auger 16 in the anteroposterior direction. The cross-sectional area of a region in which the developer is transported by the transport blade 16*b* is larger in the range in which the small-diameter portion 21 extends than in the development range 22. Hence, the speed of developer transport is higher in the range in which the small-diameter portion 21 extends than in the development range 22. Hence, the developer that has flowed into the supply chamber 6 through the first inflow portion 8*a* is quickly transported toward the downstream side.

Figure 6:
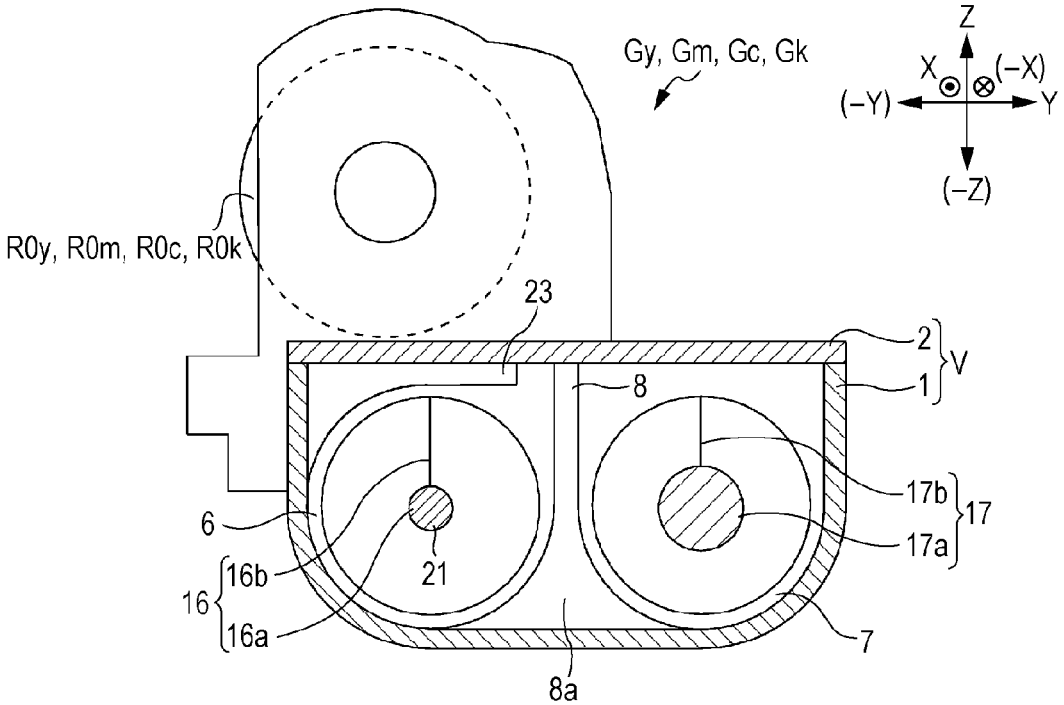
FIG. 6 is a sectional view taken along line VI-VI illustrated in FIG. 4.

FIG. 6 is a sectional view taken along line VI-VI illustrated in FIG. 4.

Referring to FIGS. 5 and 6, in the supply chamber 6 according to the first exemplary embodiment, a regulating projection 23 as an exemplary regulating member is provided at a position on the downstream side with respect to the small-diameter portion 21 and on the upstream side with respect to the upstream end 22*a* of the development range 22. Referring to FIG. 6, the regulating projection 23 according to the first exemplary embodiment is shaped such that the lower end thereof on a side near the pickup magnetic pole S3 conforms to the outer circumference of the supply auger 16.

In the above-configured developing device Gy according to the first exemplary embodiment, in the development range 22 where development is performed, the amount of developer to be attracted to the developing sleeve 12 is determined by the developability that is determined by the charging characteristics of the developer, the magnetic flux density of the pickup magnetic pole S3, and other associated factors.

To stably attract the developer to the developing roller R0*y* with a reduced magnetic flux density of the pickup magnetic pole S3, the developer may be brought close to the surface of the developing roller R0*y*. To bring the developer close to the developing roller R0*y*, the diameter of the rotating shaft 16*a* of the supply auger 16 may be increased.

However, if the diameter of the rotating shaft 16*a* is increased, the speed of developer transport is reduced. In the first exemplary embodiment, the small-diameter portion 21 is provided at a position corresponding to the first inflow portion 8*a*. Hence, the developer having flowed into the supply chamber 6 through the first inflow portion 8*a* is quickly transported toward the downstream side.

In the above configuration, the speed of developer transport may change at the downstream end of the small-diameter portion 21. Hence, as illustrated by a dash-dot line in FIG. 5, the developer tends to accumulate up to a high level around the downstream end of the small-diameter portion 21. Consequently, such developer may be quickly attracted to the developing roller R0*y* again without being stirred sufficiently.

In the developing device Gy according to the first exemplary embodiment, the regulating projection 23 is provided at a position corresponding to the downstream end of the small-diameter portion 21. Hence, in the development range 22 that is on the downstream side with respect to the regulating projection 23, the height of the mound of developer is regulated to a level that is defined by the regulating projection 23 as illustrated by the dash-dot line in FIG. 5.

Furthermore, referring to FIG. 6, the regulating projection 23 according to the first exemplary embodiment extends up to a position facing the pickup magnetic pole S3. Therefore, the mound of developer formed with the supply of developer that has been stopped by the trimmer 13 and has then returned into the supply chamber 6 is regulated by the regulating projection 23.

Second Exemplary Embodiment

Figure 7:
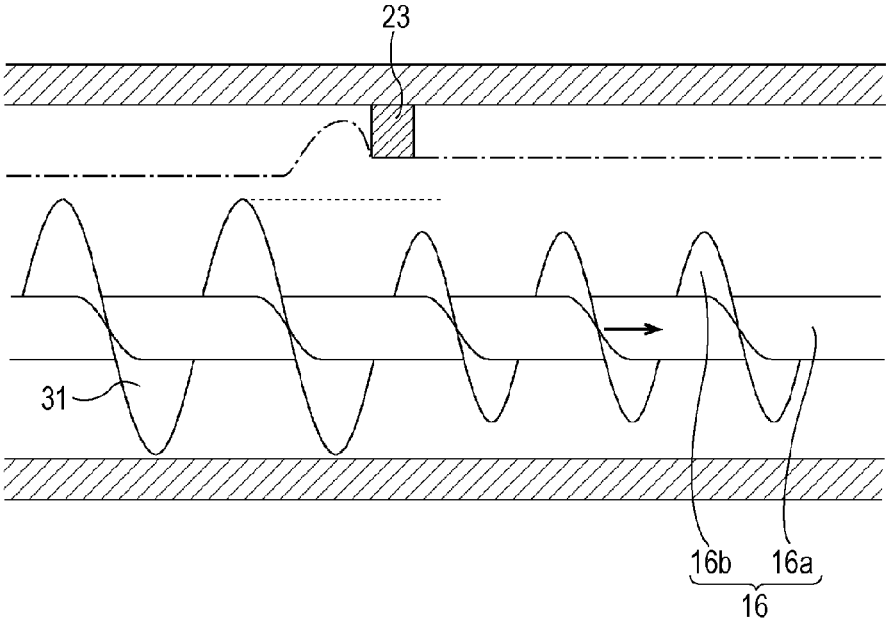
FIG. 7 illustrates a regulating member according to a second exemplary embodiment and corresponds to FIG. 5 illustrating the first exemplary embodiment.

FIG. 7 illustrates a regulating member according to a second exemplary embodiment and corresponds to FIG. 5 illustrating the first exemplary embodiment.

The second exemplary embodiment of the present invention will now be described. In the second exemplary embodiment, elements corresponding to those described in the first exemplary embodiment are denoted by corresponding ones of the reference numerals used in the first exemplary embodiment, and detailed description thereof is omitted.

The second exemplary embodiment is the same as the first exemplary embodiment, except the following features.

Referring to FIG. 7, the developing device Gy according to the second exemplary embodiment differs from the developing device Gy according to the first exemplary embodiment in that the rotating shaft 16*a* has a constant shape over the entirety thereof in the anteroposterior direction. Furthermore, in the second exemplary embodiment, a transport blade 31 is provided in the range corresponding to the first inflow portion 8*a*. The transport blade 31 has a larger outside diameter than the transport blade 16*b* provided in the development range 22. That is, the transport blade 31 having a large diameter constitutes a high-speed transport portion according to the second exemplary embodiment.

Third Exemplary Embodiment

Figure 8:
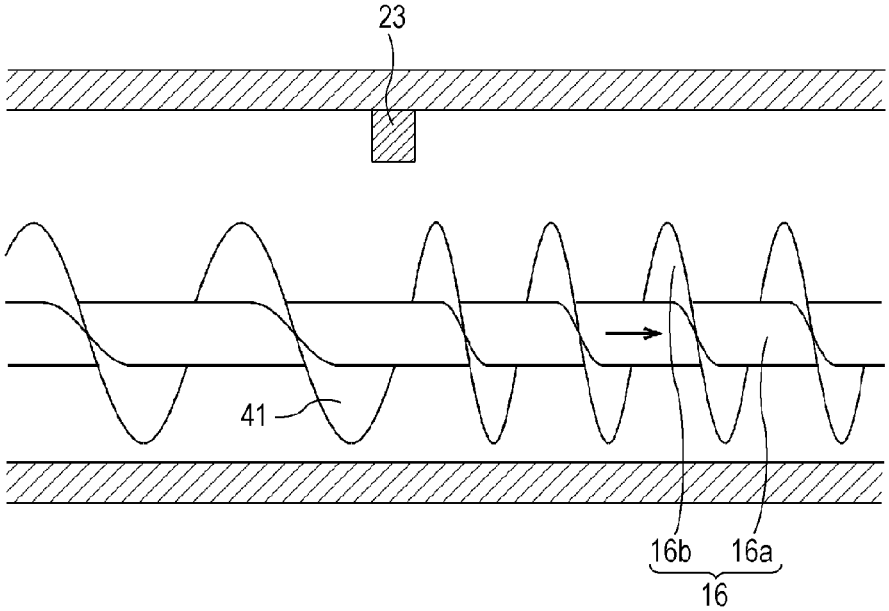
FIG. 8 illustrates a regulating member according to a third exemplary embodiment and corresponds to FIG. 5 illustrating the first exemplary embodiment.

FIG. 8 illustrates a regulating member according to a third exemplary embodiment and corresponds to FIG. 5 illustrating the first exemplary embodiment.

The third exemplary embodiment of the present invention will now be described. In the third exemplary embodiment, elements corresponding to those described in the first exemplary embodiment are denoted by corresponding ones of the reference numerals used in the first exemplary embodiment, and detailed description thereof is omitted.

The third exemplary embodiment is the same as the first exemplary embodiment, except the following features.

Referring to FIG. 8, the developing device Gy according to the third exemplary embodiment differs from the developing device Gy according to the first exemplary embodiment in that the rotating shaft 16*a* has a constant shape over the entirety thereof in the anteroposterior direction. Furthermore, in the third exemplary embodiment, a transport blade 41 is provided in the range corresponding to the first inflow portion 8*a*. The length by which the transport blade 41, which has a helical or substantially helical shape, advances in the axial direction during one revolution of the rotating shaft 16*a*, i.e., the pitch of the helical or substantially helical transport blade 41, is larger than the pitch of the transport blade 16*b* provided in the development range 22. That is, the transport blade 41 having a large pitch constitutes a high-speed transport portion according to the third exemplary embodiment.

Fourth Exemplary Embodiment

Figure 9:
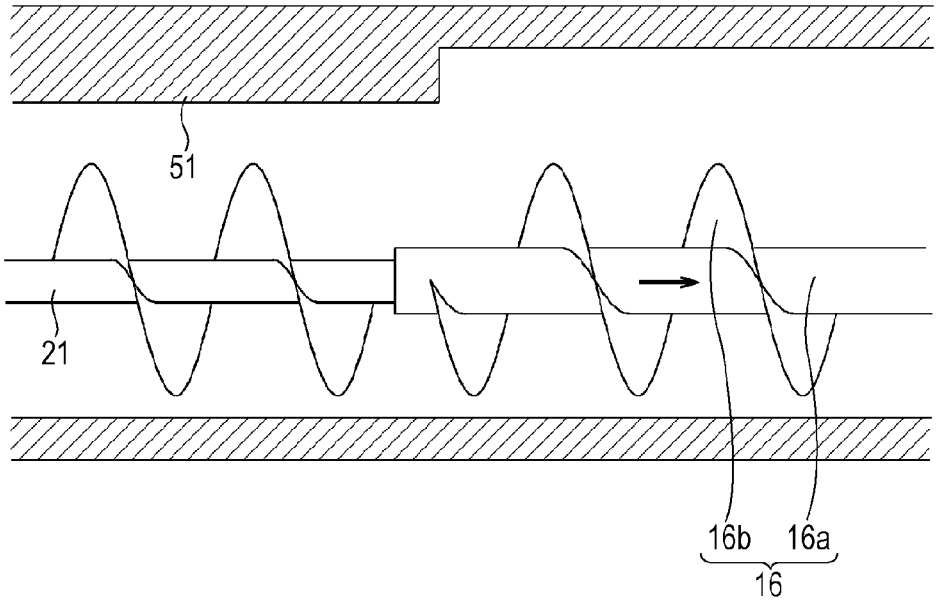
FIG. 9 illustrates a regulating member according to a fourth exemplary embodiment and corresponds to FIG. 5 illustrating the first exemplary embodiment.

FIG. 9 illustrates a regulating member according to a fourth exemplary embodiment and corresponds to FIG. 5 illustrating the first exemplary embodiment.

The fourth exemplary embodiment of the present invention will now be described. In the fourth exemplary embodiment, elements corresponding to those described in the first exemplary embodiment are denoted by corresponding ones of the reference numerals used in the first exemplary embodiment, and detailed description thereof is omitted.

The fourth exemplary embodiment is the same as the first exemplary embodiment, except the following features.

Referring to FIG. 9, the developing device Gy according to the fourth exemplary embodiment includes a ceiling portion 51, instead of the regulating projection 23, as an exemplary regulating member. The ceiling portion 51 according to the fourth exemplary embodiment is a portion of the ceiling of the container covering 2 that faces the small-diameter portion 21 and projects downward with respect to the other portion of the ceiling of the container covering 2 that extends in the development range 22.

MODIFICATIONS

While the exemplary embodiments of the present invention have been described above in detail, the present invention is not limited thereto. Various modifications may be made to the above exemplary embodiments within the scope of the present invention defined by the appended claims. Exemplary modifications (H01) to (H04) of the present invention will now be described.

(H01) While the above exemplary embodiments each concern a copier as an exemplary image forming apparatus, the image forming apparatus according to the present invention is not limited to a copier and may be, for example, a printer, a facsimile, or a multifunction machine having some of or all of such functions.

(H02) While the above exemplary embodiments each concern a case where the copier U uses developers having four respective colors, the present invention is not limited to such a case and is also applicable to, for example, a monochrome image forming apparatus or a multicolor image forming apparatus that uses five or more or three or less colors.

(H03) While the first to third exemplary embodiments each employ the high-speed transport portion, the present invention is not limited to such an exemplary embodiment. For example, configurations according to the first to third exemplary embodiments may be combined in any way.

(H04) The shape, the size, and the length in the anteroposterior direction of the regulating member are not limited to those described in the above exemplary embodiments and may be changed arbitrarily in accordance with the design, specifications, and other associated factors.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer container that contains developer;

a developer carrying body provided in the developer container and configured to rotate while carrying the developer, the developer carrying body facing an image carrying body on which a latent image is to be formed;

a first transport member including a rotating shaft and a transport blade supported by the rotating shaft, the first transport member being configured to transport the developer in the developer container while stirring the developer;

a second transport member including a rotating shaft and a transport blade supported by the rotating shaft, the second transport member being provided parallel to the first transport member in a horizontal direction and being configured to transport the developer while stirring the developer, the second transport member transporting the developer in a second direction opposite to a first direction in which the first transport member transports the developer;

a partition member provided between the first transport member and the second transport member and separating a space in the developer container into a first housing in which the first transport member is provided and a second housing in which the second transport member is provided;

an inflow portion provided in the developer container at a downstream end in the second direction and on an outer side with respect to an end of the developer carrying body, the inflow portion allowing the developer to flow from the second housing into the first housing;

a high-speed transport portion provided in a range corresponding to the inflow portion and extending in the first direction, the high-speed transport portion being configured to transport the developer at a higher speed than a speed at which the developer in a range corresponding to the developer carrying body is transported; and a regulating member provided at a position corresponding to a downstream end of the high-speed transport portion in the first direction, the regulating member being configured to regulate a height of a mound of developer in the first housing.

2. The developing device according to claim 1, wherein the high-speed transport portion includes a rotating shaft that is thinner than the rotating shaft of the first transport member provided in the range corresponding to the developer carrying body.

3. The developing device according to claim 1, wherein the high-speed transport portion includes a transport blade having an outside diameter that is larger than an outside diameter of the transport blade of the first transport member provided in the range corresponding to the developer carrying body.

4. The developing device according to claim 1, wherein the transport blade of the first transport member has a substantially helical shape, wherein the high-speed transport portion includes a substantially helical transport blade supported by a rotating shaft, and wherein the substantially helical transport blade of the high-speed transport portion advances by a larger length in an axial direction during one revolution of the first transport member than the substantially helical transport blade of the first transport member provided in the range corresponding to the developer carrying body.

5. An image forming apparatus comprising:

an image carrying body;

a latent image forming device configured to form a latent image on a surface of the image carrying body;

the developing device according to claim 1 configured to develop the latent image on the surface of the image carrying body into a visual image;

a transfer device configured to transfer the visual image from the surface of the image carrying body to a medium; and a fixing device configured to fix the visual image on the medium.

* * * * *